United States Patent [19]

Wandler

[11] 4,156,272

[45] May 22, 1979

[54] MOUNTING BRACKET FOR LIGHT FIXTURE

[75] Inventor: Donald Wandler, South Milwaukee, Wis.

[73] Assignee: McGraw-Edison Company, Elgin, Ill.

[21] Appl. No.: 823,386

[22] Filed: Aug. 10, 1977

[51] Int. Cl.[2] ..... F21S 1/02; F21S 3/02

[52] U.S. Cl. ..... 362/432; 248/219.4; 362/147; 362/365; 362/370; 362/431

[58] Field of Search ..... 362/431, 432, 147, 150, 362/151, 365, 368, 370; 248/221

[56] References Cited

U.S. PATENT DOCUMENTS 3,906,145 9/1975 Carmichael ..... 362/432

FOREIGN PATENT DOCUMENTS 570835 2/1959 Canada ..... 362/432

1539426 10/1966 Fed. Rep. of Germany ..... 362/432

*Primary Examiner*—Samuel W. Engle

*Assistant Examiner*—Donald P. Walsh

*Attorney, Agent, or Firm*—Jon C. Gealow; Thomas E. McDonald; Bruce R. Mansfield

[57] ABSTRACT

A mounting bracket formed integrally with a light fixture housing, mounts the fixture on either a flat surface, such as, a wall or a curved surface, such as, a post. The bracket includes a base portion having a front wall and opposed parallel side walls and opposed parallel upper and lower end walls joined to the rear surface of the front wall to define a cavity. The free ends of the upper and lower end walls are arcuate, curving inwardly from the opposite side walls toward the front wall for accommodating a cylindrical post or the like support member. A hollow support arm extends from the front surface of the front wall of the base portion to the housing and carries electrical wiring between the housing and the base portion of the mounting bracket. A pair of apertures for receiving mounting screws are defined in the front wall, one at each upper and lower end of the base portion. A gasket received in the base portion is held between shoulders formed on the rear surface of the front wall between the screw receiving apertures. Apertures on opposite sides of the upper mounting screw aperture, between the upper shoulder and upper end wall, permit electrical wiring to pass outwardly of the base portion for externally wiring the light fixture.

5 Claims, 5 Drawing Figures

MOUNTING BRACKET FOR LIGHT FIXTURE

BACKGROUND OF THE INVENTION

This invention relates generally to light fixtures and more particularly to mounting brackets therefor.

In the prior art, brackets for mounting light fixtures on the walls of buildings and the like supporting members are well known, see for example, U.S. Pat. No. 3,906,145. Brackets for mounting light fixtures on cylindrical posts are also shown in the prior art, see for example, U.S. Pat. Nos. 3,468,506 and 3,264,465. No light fixture, however, having a mounting bracket provided thereon which can accommodate both a relatively flat and cylindrical surface has been found.

SUMMARY OF THE INVENTION

Accordingly, it is a primary object of the present invention to provide in a light fixture, a new and improved mounting bracket which can accommodate a relatively flat surface, such as the side wall of a building, as well as an arcuate or curved surface, such as, for example, a post.

It is a further object of the present invention to provide a mounting bracket of the above described type which is formed integrally with the light fixture housing.

It is yet another object of the present invention to provide a mounting bracket of the above-described type which is relatively simple in design, yet effective for mounting a light fixture on either a flat or curved surface.

Briefly, a preferred embodiment of the mounting bracket according to the invention for mounting a light fixture on a relatively flat surface, such as the side wall of a building or on a post having a generally cylindrical shape, includes a base portion having a front wall, and opposed parallel side walls and opposed parallel upper and lower end walls joined to the rear surface of the front wall to define a cavity. The free ends of the upper and lower end walls are arcuate, curving inwardly from the opposite side walls toward the front wall for accommodating a cylindrical post or the like support.

A hollow support arm joins the base portion and light fixture housing, extending from the front surface of the front wall of the base portion to the housing. The arm carries electrical wiring between the housing and base portion.

A pair of slotted apertures for receiving mounting screws are defined at opposite upper and lower ends of the base portion. A rubber gasket is received in the cavity between the slotted apertures to seal the base portion against the support member. Shoulders formed on the rear surface of the front wall of the base portion support the gasket therebetween.

When mounting the light fixture on a flat wall surface, an electrical connector box from which electrical power is obtained, extends outwardly from the wall and is received within the rubber gasket. When the fixture is mounted on a cylindrical post, the gasket is pressed against and conforms to the outer surface of the post.

DETAILED DESCRIPTION OF THE DRAWINGS

Figure 1:
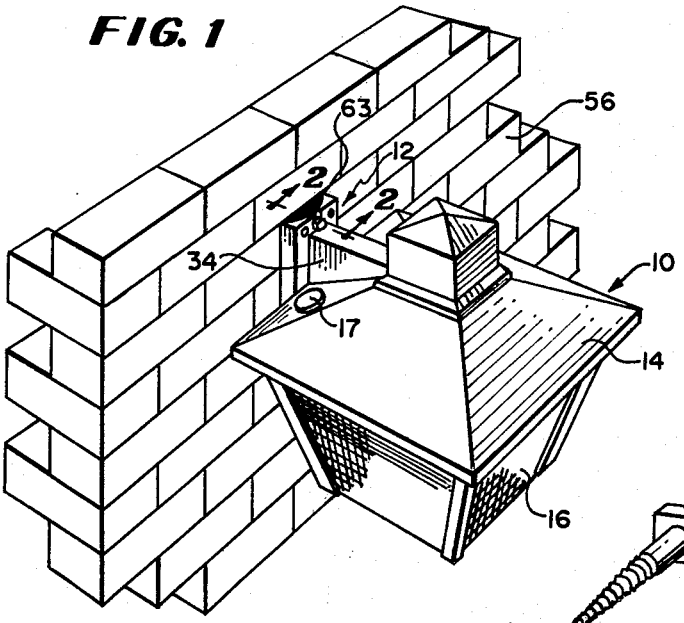
FIG. 1 is a perspective view of a light fixture including a mounting bracket according to the invention mounted on a relatively flat surface, such as the side wall of a building.

Referring now to the drawing in greater detail wherein like numerals have been employed throughout the various views to designate similar components, there is illustrated in FIG. 1 a light fixture 10 including a mounting bracket 12 according to the invention.

The light fixture shown has traditional styling and includes an upper housing section 14 conventionally cast of a suitable metal such as, for example, aluminum and a lens or refractor section 16 attached thereto. The electrical components including the lamp socket (not shown) are provided in the upper housing section. A photo control device 17 of the conventional type is mounted on the housing section for controlling the operation of the light fixture according to the ambient light.

The particular light fixture shown can be used as a security light and is therefore advantageously mountable on both flat surfaces, such as the side wall of a building and on a cylindrical post or the like support member.

Figure 3:
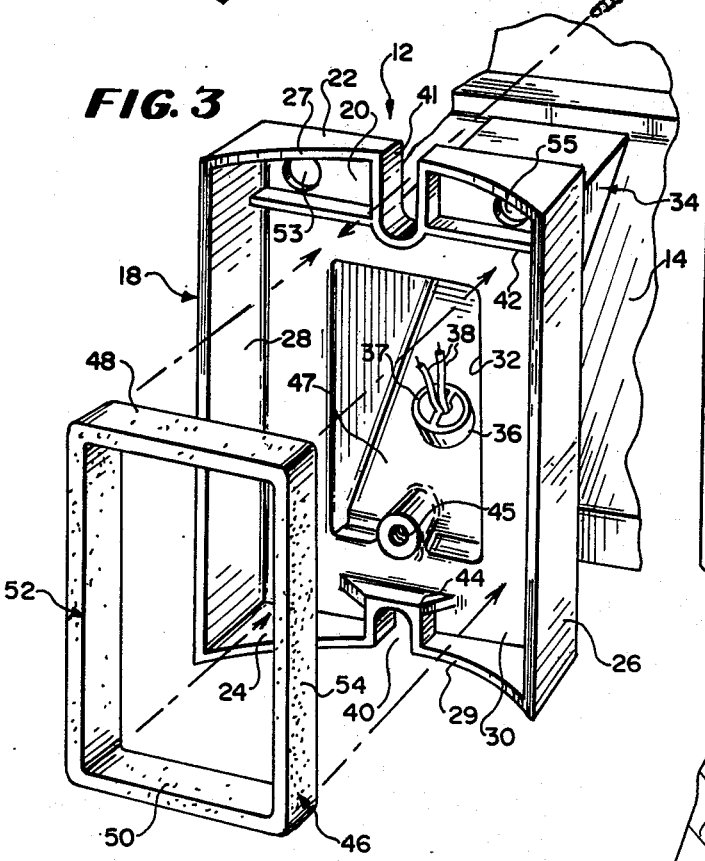
FIG. 3 is an exploded, enlarged, fragmentary, perspective view of the mounting bracket according to the invention illustrating the base portion thereof.

The mounting bracket 12 according to the invention is preferably formed integrally with the upper housing section 14. Referring to FIG. 3 of the drawing, bracket 12 is shown therein from the rear. The bracket includes a base portion 18 and an arm 34 joined thereto.

Base portion 18 includes a front wall 20, upper and lower end walls 22, 24 and side walls 26, 28 joined together at the rear surface of the front wall to define a hollow cavity 30. The free ends 27, 29 of upper and lower end walls, respectively, are arcuate in shape, curving inwardly toward the rear surface of front wall 20 from the opposite side walls 26, 28 as shown in FIG. 3. The curved ends of the end walls as will be described hereinafter, permit the mounting of the light fixture 10 on a post or other arcuately curved support surface. The front wall 20 also includes a central aperture 32 defined therein.

Arm 34 joins the housing section 14 and the base portion of the mounting bracket. The arm 34 extends from the front surface of the front wall 20 and is hollow. An aperture 36 in the housing section within arm 34 provides a passage via central aperture 32 in front wall 20 of the base portion, for electrical wires or leads 38 (see FIGS. 2 2 and 5) coupled to the electrical components (not shown) of the light fixture. Grommet 37 secures the wires 38 in aperture 36.

Figure 4:
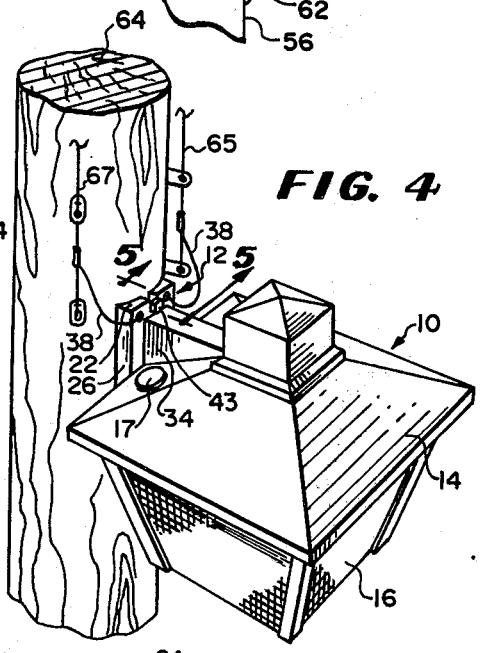
FIG. 4 is a perspective view of a light fixture including a mounting bracket according to the invention shown mounted on the surface of a cylindrical post.
Figure 5:
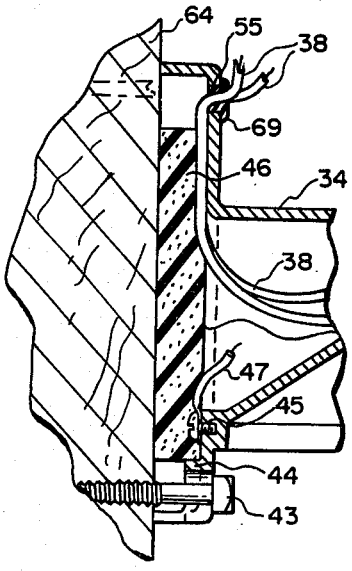
FIG. 5 is a sectional view of the mounting bracket of FIG. 4 taken along the line 5—5.

Slotted apertures 40, 41 are defined in the base portion at opposite upper and lower ends thereof. Suitable fasteners, such as screw 43, are received in each of the slotted apertures for attaching the light fixture to a mounting surface. The apertures are open at end walls 22, 24, respectively, to minimize the cost of casting the housing section 14 of the fixture 10. Shoulders 42, 44 are formed in cavity 30 on the rear surface of the front wall adjacent the closed ends of the slotted apertures, each of the last-mentioned apertures thereby being located between an end wall and shoulders, respectively. An internally threaded grounding post 46 is provided on the wall surface 47 of the housing section 14 within hollow arm 34. Two other apertures 53, 55 are defined in front wall 20 on opposite sides of slotted aperture 40, between the upper end wall and shoulder 42. These apertures are provided for externally wiring the light fixture. This feature will be explained in greater detail when referring to the mounting of the fixture on a post or the like support as shown in FIGS. 4 and 5 of the drawing.

A gasket 46 made of rubber or the like material is shaped for receipt in the cavity 30 of the base portion between shoulders 42, 44. The gasket in the case of the embodiment shown is in the shape of a rectangle including end walls 48, 50 and side walls 52, 54, joined together as shown in FIG. 3 to form a ring.

Figure 2:
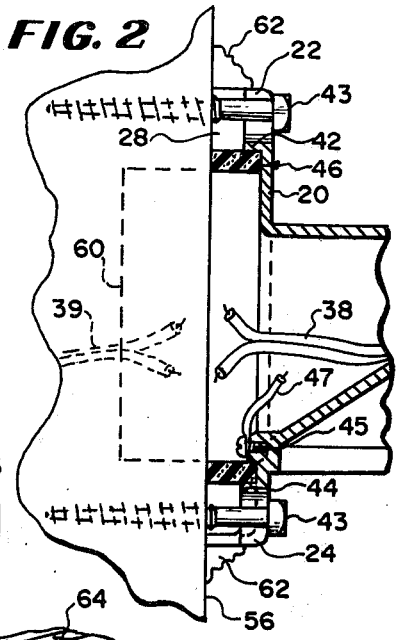
FIG. 2 is a cross sectional view of the mounting bracket of FIG. 1 taken along the line 2—2.

When mounting the light fixture 10 on a flat surface, such as wall 56, FIG. 1, the free ends of side walls 26, 28 are oriented vertically and butted up to the wall surface (see FIG. 2). Rubber gasket 46 is positioned in place in cavity 30 between shoulders 42, 44 and the gasket is received over the exterior of an electrical connector box 60 extending outwardly from the building wall, through which power is supplied to the light fixture via leads 39. Suitable connectors (not shown) can be provided to join power leads 39 and light fixture leads 38. A ground lead 47 is coupled to the grounding post 45 provided in the housing. Screws 43 received in slotted apertures 40, 41 serve to attach the light fixture to the building wall (FIGS. 1 and 2).

When mounted on a flat wall surface such as 56, gaps such as 63, FIG. 1, will be present at end walls 22, 24 between the outer ends thereof and the building wall. These gaps can, if desired, be sealed with caulking or the like compound such as 62 (FIG. 2). Caulking however may not be necessary as the rubber gasket 46 serves to seal the base portion and electrical connector box.

When mounting the light fixture on a curved surface, such as a wooden post 64 or the like support (FIGS. 4 and 5) which is externally wired by means of electrical power lines 65, 67 attached to the post, the base portion of the mounting bracket is butted up to the post surface again with the side walls being oriented vertically. In this case, the curved ends 27, 29 of upper and lower end walls 22, 24, respectively, will conform generally to the contour of the cylindrical post surface as shown. Screws 43 are used to retain the light fixture on the post by insertion into the post through slotted apertures 40, 41, respectively. Gasket 46 is also received between shoulders 42, 44 in cavity 30 and is pressed against the exterior surface of the post to seal the base portion of the bracket thereagainst. Electrical leads 38 extending from within the light fixture housing are sandwiched between the gasket and front wall 20 of the base portion and exit via apertures 53, 55 (see FIG. 5) for connection to the power lines 65, 67 as shown in FIG. 4. Grommets such as 69 (FIG. 5) inserted into apertures 53, 55, prevent abrasion of the wires 38.

It can be seen that a light fixture including a mounting bracket according to the invention can be mounted relatively easily and securely to either a flat wall surface such as building wall 56 (FIG. 1) or to a curved surface such as post 64. No special adaptors or components are required for mounting the fixture on either of such mounting surfaces.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. In a light fixture having a housing comprising electrical components including a lamp socket and a refractor coupled to said housing, a mounting bracket for securing said fixture to one of a relatively flat surface having an electrical junction box mounted therein, such as, for example, the side wall of a building and an arcuately curved surface, such as, for example, a post or the like support member, said mounting bracket including in combination:

a base portion having a front wall, upper and lower end walls and side walls joined to and extending outwardly from the rear surface of said front wall to define a cavity, and a hollow support arm formed integrally with said bracket and fixture housing and extending between the front surface of said front wall of said base portion and said fixture housing, said end walls of said base portion being arcuately curved at the free ends thereof, respectively, said ends curving inwardly from said opposite side walls toward the front wall intermediate said side walls, respectively, to accommodate the curved surface of a post or the like support member on which said fixture is mountable, said front wall defining a first aperture therein communicating with and surrounded by said hollow support arm for passing electrical wiring from said lamp socket into said base portion, first and second predeterminedly spaced shoulders formed on the rear surface of said front wall of said base portion of said bracket near the upper and lower end walls, respectively, said shoulders extending into said cavity, said front wall defining second and third apertures at opposite ends thereof for receiving fasteners with which to mount said fixture on one of said flat and curved support surfaces, respectively, each of said apertures being positioned between one of said opposite end walls and an adjacent one of said shoulders, and a gasket formed of resilient material receivable in said cavity between said shoulders to seal said base portion against said mounting surface and to provide a barrier around said cavity to minimize the entry of moisture thereinto, said gasket being ring-shaped having joined side and end walls and being dimensioned for receipt of said electrical junction box therein, in sealing engagement therewith, when mounting said light fixture on said flat surface.

2. A mounting bracket as claimed in claim 1 wherein said second and third apertures comprise slotted apertures formed at opposite upper and lower ends of said base portion, said slotted apertures being open at the end walls of said base portion.

3. A mounting bracket as claimed in claim 2 wherein said front wall defines fourth and fifth apertures adjacent said upper slotted aperture and between said upper shoulder and said upper end wall, for use in passing electrical wiring outwardly of said base portion for externally wiring said fixture.

4. A light fixture including in combination: a housing portion including a lamp socket mounted thereon, a refractor coupled thereto and a bracket portion formed integrally with said housing portion for mounting said light fixture on one of a relatively flat surface having an electrical junction box mounted therein and a curved surface, said mounting bracket comprising; a base having a front wall, upper and lower end walls and side walls joined thereto extending outwardly from the rear surface of said front wall to define a cavity and a hollow support arm extending between the front surface of said front wall of said base and said housing, said end walls of said base being curved at the free ends thereof, respectively, inwardly from the opposite side walls toward the front wall, intermediate the side walls, respectively, to accommodate said curved surface on which said bracket is mountable, said front wall of said base defining a first aperture therein communicating with and surrounded by said hollow support arm for passing electrical wiring from said housing portion and lamp socket into said base, first and second predeterminedly spaced shoulders formed on the rear surface of said front wall of said base of said bracket portion near the upper and lower end walls, respectively, said shoulders extending into said cavity, said front wall defining second and third apertures at opposite ends thereof for receiving fasteners with which to mount said fixture on one of said flat and curved support surfaces, respectively, each of said apertures being positioned between one of said opposite end walls and an adjacent one of said shoulders, a gasket formed of resilient material receivable in said cavity between said shoulders and side walls and engaging the rear surface of said front wall of said base in surrounding relation with respect to said first aperture to create a barrier, thereby minimizing the entry of moisture into said cavity, said gasket being ring-shaped and dimensioned for receipt of said electric junction box therein in sealing engagement therewith when mounting said light fixture on said flat surface.

5. A light fixture as claimed in claim 4 wherein said front wall of said base further defines fourth and fifth apertures adjacent one of said second and third apertures for passing electric wiring outwardly of said base portion for externally wiring said fixture, and second and third gasket means mounted in said second and third apertures, respectively, to seal said external wiring at said apertures.

* * * * *